US008254825B2

(12) United States Patent
Tooker et al.

(10) Patent No.: US 8,254,825 B2
(45) Date of Patent: Aug. 28, 2012

(54) CONTROLLING SHEET REGISTRATION IN A DIGITAL PRINTING SYSTEM

(75) Inventors: Ana P. Tooker, Penfield, NY (US); Michael James Diehl, Rochester, NY (US); Colleen R. Enzien, Penfield, NY (US); Thomas Edward Higgins, Fairport, NY (US); David Robert Kretschmann, Webster, NY (US); Carlos A. Lopez, Webster, NY (US); Andrew James Bonacci, Webster, NY (US); Jacqueline Yvonne Tyson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 424 days.

(21) Appl. No.: 12/388,101

(22) Filed: Feb. 18, 2009

(65) Prior Publication Data

US 2010/0209161 A1 Aug. 19, 2010

(51) Int. Cl.
*G03G 15/00* (2006.01)
*G03G 15/22* (2006.01)

(52) U.S. Cl. ..... 399/394; 399/162; 399/306

(58) Field of Classification Search ..... 399/394, 399/306, 162, 401
See application file for complete search history.

(56) References Cited

U.S. PATENT DOCUMENTS

2004/0202489 A1* 10/2004 Kudou et al. ..... 399/66
2006/0269339 A1* 11/2006 Okamoto et al. ..... 399/401
2007/0122193 A1* 5/2007 Carolan ..... 399/167
2008/0260445 A1* 10/2008 Costanza et al. ..... 399/394

* cited by examiner

*Primary Examiner* — Judy Nguyen
*Assistant Examiner* — Blake A Tankersley
(74) *Attorney, Agent, or Firm* — Fay Sharpe LLP

(57) ABSTRACT

A digital printing system employing tandem marking engines for duplex printing utilizing a variable dwell time in the output sheet inverter of the first marking engine to provide correct positioning of the leading edge of the inverted sheet for arrival at the entrance of the second marking to avoid the seam in the photoreceptor.

14 Claims, 3 Drawing Sheets

CONTROLLING SHEET REGISTRATION IN A DIGITAL PRINTING SYSTEM

BACKGROUND

The present disclosure relates to digital printing systems having plural tandem marking or printing engines of the type with seamed endless photoreceptor belts. In such printing systems, it is common practice to invert the sheet after marking on one side thereof in a first of the printing engines and for feeding the inverted sheet into a second printing engine for marking on the opposite side of the sheet to thus facilitate high speed duplex digital printing. However, in printing systems of this type arrangement, problems have been encountered in proper registration of the leading edge of the inverted sheet onto the photoreceptor of the second printing engine for proper placement of the image on the sheet and for avoiding the seam in the photoreceptor of the second marking engine. Where the inverted sheet from the first marking engine is transported by a transporter to the second marking engine, errors in timing, transport speed and positioning of the sheet can accumulate to cause misregistration of the sheet on the second photoreceptor. This is particularly troublesome in view of the requirement that the sheet be placed on the second photoreceptor within a window of plus or minus 30 milliseconds timing with respect to the movement of the photoreceptor.

Typically, tandem marking engines employed for duplex printing operate to synchronize the position of the seams by varying the speed of the photoreceptor in the second marking engine and can result in problems with front to back image-to-paper registration due to paper shrinkage from heating in the first marking engine's fuser and differences in the photoreceptor belt length causing varied photoreceptor speed.

Heretofore digital printing systems employing tandem marking engines for duplex printing have operated in accordance with the procedure shown in FIG. 3 wherein at step 60 the system schedules the arrival times of the sheet stock in the initial and subsequent marking engines; and, proceeds to have the feeder eject the sheet stock at step 62 to meet the scheduled arrival time as determined in step 60, at step 64 arrives at the entrance of the first marking engine and is registered thereon at step 66 for upper registration for marking. At step 68, the sheet is registered for image transfer from the photoreceptor belt and arrives at the discharge exit at the first marking engine at step 70. The system then submits the sheet stock to the inverter at step 72; and, at step 74 the inverter discharges the sheet stock after a fixed dwell time.

Thus, it has been desired to provide a way of improving the registration of the leading edge of sheets emanating from a first tandem marking engine onto the second marking engine.

BRIEF DESCRIPTION

The present disclosure describes a digital printing system employing tandem marking engines for duplex printing and utilizes a variable dwell time in the output inverter of the first marking engine to provide for correct positioning of the leading edge of the inverted sheet for arrival at the entrance of the second marking engine. The system presently disclosed avoids the seam in the photoreceptor of the second marking engine and properly positions the leading edge of the sheet for correct front-to-back image registration on the second photoreceptor for image transfer to the sheet. The system of the present disclosure thus eliminates the need to synchronize the seam positions of the photoreceptors in the tandem marking engines and permits the speed of the photoreceptor in the second marking engine to be varied for purposes of controlling the image magnification thereon without regard to seam position.

DETAILED DESCRIPTION

Figure 1:
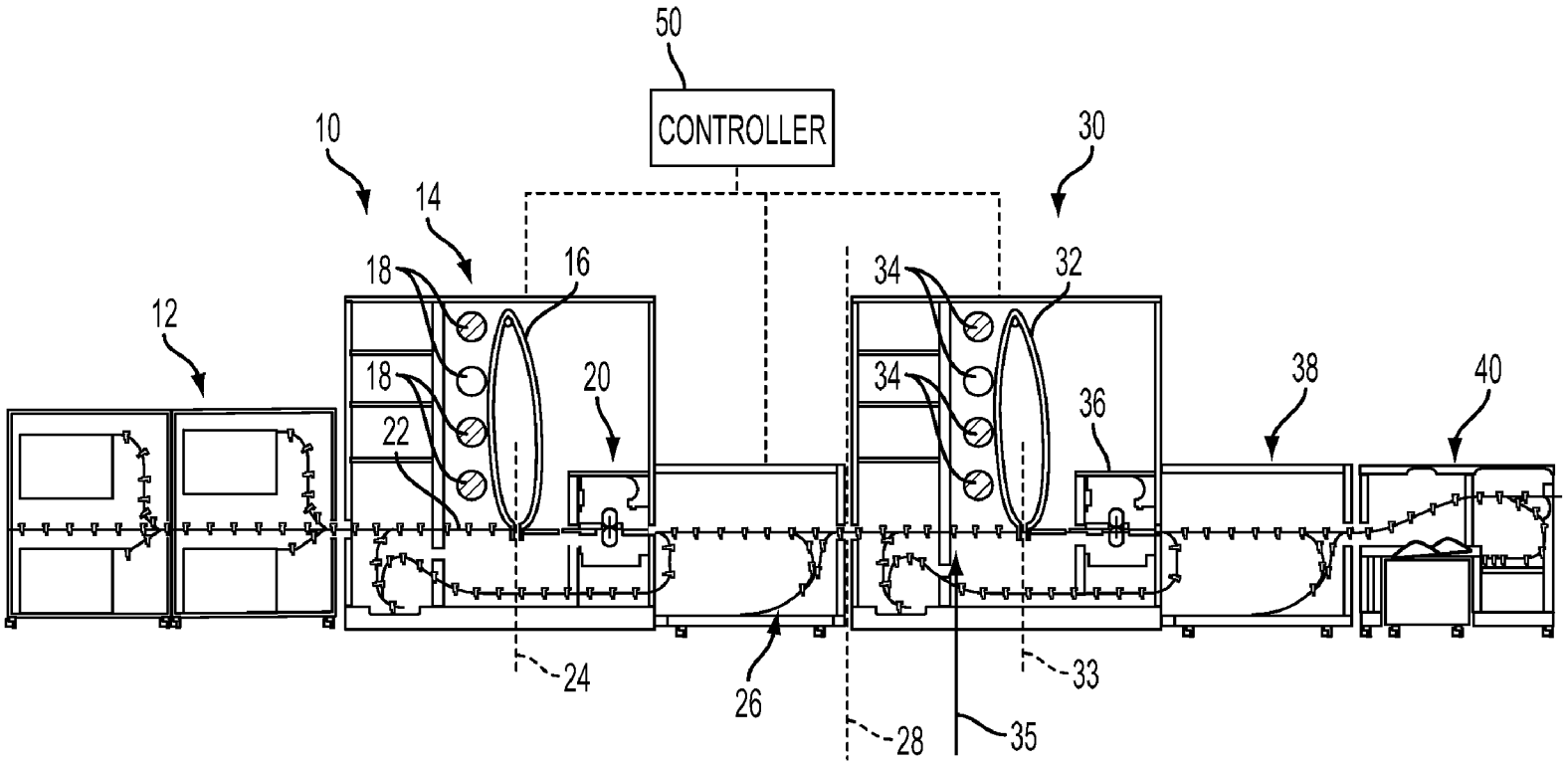
FIG. 1 is a schematic of a digital printing system having plural marking engines in tandem in accordance with the present disclosure.

Referring to FIG. 1, a digital printing system according to the present disclosure is indicated generally at 10 and includes a sheet feeder assembly indicated generally at 12, a first marking engine indicated generally at 14 including a photoreceptor belt 16 of the endless seamed type and a plurality of colorant generators 18 operative for effecting color image formation on the belt 16. The marking engine 14 includes a fuser indicated generally at 20 and a transporter providing a transport path 22 through the marking engine. The photoreceptor 16 is operative to transfer the image to the sheet stock on path 22 at a transfer station indicated in dashed outline and denoted with reference numeral 24.

From the marking at station 24, the sheet stock is advanced along path 22 and is discharged from the fuser 20 along path 22 to an inverter 26 which inverts the marked sheet and maintains the sheet for a controlled dwell time before reentry onto the path 22 and movement to the entrance station 28 for the second marking engine indicated generally at 30.

The sheet stock is controlled, as will hereinafter be described, to arrive at the registration point indicated by the arrow and denoted by reference numeral 35 in marking engine 30 at a controlled time.

The second marking engine 30 includes a photoreceptor 32 of the seamed belt type and has colorant generators 34 disposed for forming a color image on the photoreceptor 32. The photoreceptor 32 is operative to transfer the color image to the second side of the sheet at a transfer station indicated in dashed outline and denoted by reference numeral 33. The marking engine 30 also includes a post-marking fuser 36, the output from which the sheet is inputted to a second inverter indicated generally at 38 which restores the sheet to its original orientation and discharges the duplex marked sheet to a finisher indicated generally at 40.

The system of FIG. 1 includes a controller 50 which is operatively connected as indicated by the dashed lines in FIG. 1 for controlling the marking engines 14, 30 and the inverter 26 as will hereinafter be described.

The system of the present disclosure allows the two marking engines to have their photoreceptors run at different speeds without the need for synchronizing the location of the photoreceptor belt seams. The controller monitors the seam position by a sensor (not shown) and then schedules the closest available image panel on the photoreceptor 32 of the second marking engine 30 with the marked image printed by the first marking engine 14. The controller is then operative to determine the time that the leading edge of the sheet stock needs to arrive at the docking plane 28 of the second marking engine 30 in order to synchronize with the time that the image will be transferred from the photoreceptor 32 to the second side of the sheet at station 33. The controller 50 of the system 10 adjusts the time the sheet stock is parked or dwells in the inverter 26 by increasing the paper path velocity downstream of the fuser, or increasing the deceleration rate of the sheet along the path 22 as it enters the inverter 26 and by increasing the acceleration rate required to eject the sheet from the inverter 26. It will be understood that the dwell time in the inverter 26 must be of sufficient length to accommodate the timing correction needed to synchronize the sheet with the scheduled arrival time at docking time plane station 28.

The system of the present disclosure thus provides a digital printing system employing tandem marking engines for duplex printing in which the need to synchronize the seams of the photoreceptor belts in the first and subsequent marking engines is eliminated and the speed of the second photoreceptor may be varied only as needed to control image magnification. The system of the present disclosure thus improves the front to back (show through) image to paper registration and improved image-to-paper registration in the process direction by having variable inverter dwell time prior to entry into the second marking engine. The system can thus accommodate variations in paper path velocity and the length of the paper due to shrinkage in the fuser and further provides for decreased cycle in time on the order of one minute as a result of elimination of the need for photoreceptor belt synchronization between the marking engines.

Figure 2:
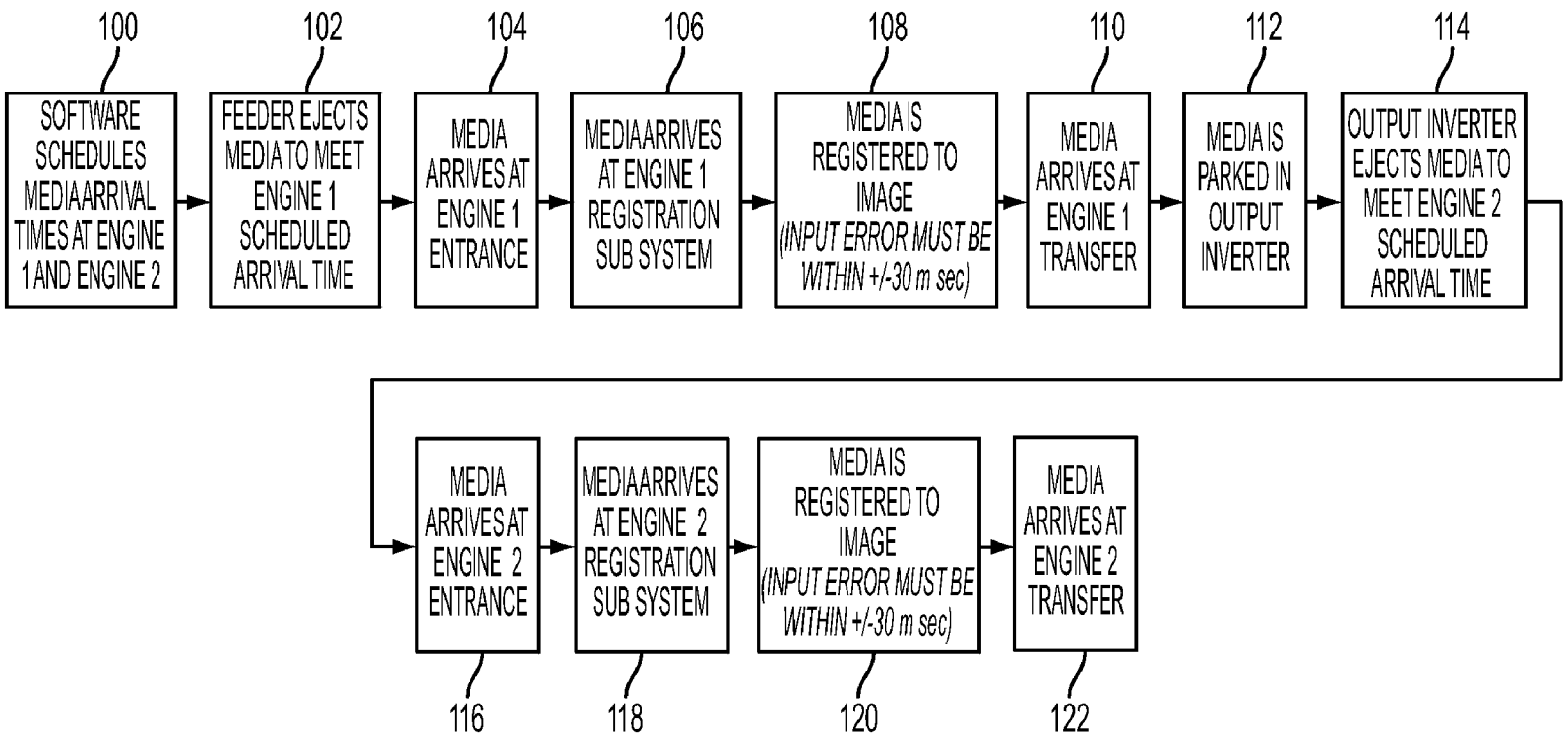
FIG. 2 is a flow diagram of the method of sheet transport control in the system of FIG. 1; and, FIG. 3 is a diagram similar to FIG. 2 of the prior art systems.
Figure 3:
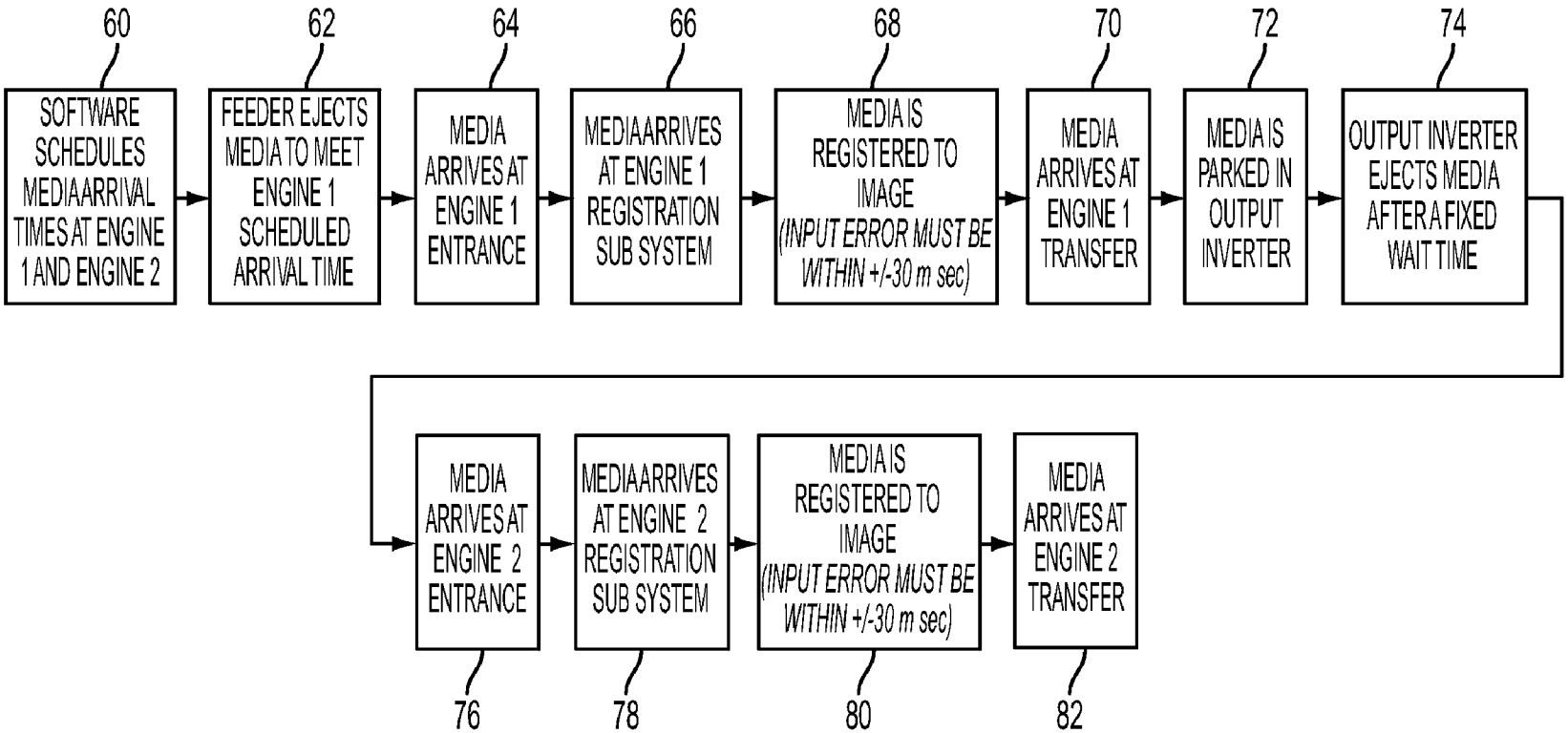
FIG. 3 PRIOR ART

Referring to FIG. 2, the process is illustrated in flow diagram wherein the controller schedules immediate arrival times at engines 1 and 2 at step 100 and proceeds to eject the sheet stock from the feeder into engine 1 at the scheduled time at step 102. The sheet stock arrives at the first marking engine entrance at step 104 and is registered at an internal registration station at step 106 and proceeds to the onset of marking at station 24 at step 108. The sheet stock then arrives at the fuser output at step 110 and is inputted to the inverter 26 at step 112. At step 114, the sheet stock is outputted from the inverter at the appropriate speed at step 114 to arrive at the scheduled time for the second marking engine. At step 116, the sheet stock arrives at the docking station 28 and at the registration station 35 of the second marking engine 30 at station 118 and proceeds at step 120 to begin image transfer at station 33 and then proceeds to output from the fuser 36 at step 122.

The sheet stock then arrives at the entrance to the second marking engine at step 76 and the registration station at 78 and proceeds to be marked by transfer of the image thereon at step 80 and is subsequently moved to the discharge station of the second marking engine at step 82.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of controlling image to print media sheet registration in a digital printing system employing a plurality of image marking engines with unsynchronized seamed photoreceptor belts comprising:

(a) disposing a first and second of the image marking engines (IME) in tandem and feeding the print media sheet from the first IME to the second IME;

(b) disposing an inverter between the first and second IME and inverting the print media sheet after marking on one side thereof in the first IME;

(c) monitoring seam positions of the seamed photoreceptor belts of the first and second IMEs and scheduling arrival times for the print media sheet to arrive at the first IME and the second IME in response to the monitored seam positions so as to avoid the seams of the seamed photoreceptor belts;

(d) varying a dwell time of the print media sheet in the inverter in response to the scheduled arrival times in order to accommodate varying amounts of time between the scheduled arrival time to the first IME and the scheduled arrival time to the second IME and controlling arrival of the print media sheet to the second IME and providing proper image registration thereon; and (e) operating the seamed photoreceptor belts independent of a synchronization therebetween.

2. The method defined in claim 1, further comprising varying the speed of transport of the print media sheet from the first IME to the inverter during transit thereof.

3. The method defined in claim 1, further comprising varying the speed of the second IME photoreceptor belt for controlling image magnification.

4. The method defined in claim 1, wherein the step of feeding the media sheet from the first IME to the second IME includes increasing the velocity of the media sheet during transit thereof.

5. The method defined in claim 1, wherein the step of feeding the print media sheet from the first IME to the second IME includes changing the deceleration rate of the media sheet prior to entry into the inverter during transit therebetween.

6. The method defined in claim 1, wherein the step of feeding the print media sheet from the first IME to the second IME includes changing the acceleration rate of the print media sheet exiting the inverter during transit thereof.

7. The method defined in claim 1, wherein the step of varying the dwell time includes scheduling the arrival of the leading edge of the print media sheet into the second IME to avoid a seam in the photoreceptor.

8. A digital printing system comprising:

(a) a first and second image marking engine (IME) disposed for feeding print media sheet stock from the first IME to the second IME, wherein the first IME including a photoreceptor belt having a photoreceptor seam at a first position and the second IME including an unsynchronized photoreceptor belt having a photoreceptor seam that is at a second position relative to the first position associated with the first IME;

(b) a transport which transports print media sheet stock from the first IME to the second IME;

(c) an inverter disposed to invert the print media sheet stock between the first IME and the second IME;

(d) sensors which monitor seam positions of the seamed photoreceptor belts of the first and second IMEs; and, (e) a controller operative to schedule arrival times for the print media sheet to arrive at the first IME and the second IME in response to the monitored seam positions so as to avoid the seams of the seamed photoreceptor belts, vary the dwell time of the print media sheet stock in the inverter in response to the scheduled arrival times in order to accommodate varying amounts of time between the scheduled arrival time to the first IME and the scheduled arrival time to the second IME and, control the arrival of the sheet stock to the second IME to avoid the photoreceptor seam associated with the second IME.

9. The system defined in claim 8, wherein the dwell time is determined in accordance with a timing correction associated with a scheduled arrival time at the second IME.

10. The system defined in claim 8, wherein the controller is further operative to increase the feed velocity of the sheet stock exiting the inverter during transit thereof.

11. The system defined in claim 8, wherein the controller is operative to change the deceleration rate of the print media sheet stock entering the inverter during transit thereof.

12. The system defined in claim 8, wherein the controller is operative for changing the acceleration rate of the print media sheet exiting the inverter during transit thereof.

13. The system defined in claim 8, wherein the controller controls the arrival of the sheet stock at the second IME via scheduling the arrival of the leading edge of the print media sheet stock into the second IME to avoid the seam in the photoreceptor.

14. A method of controlling image to print media sheet registration in a digital printing system employing a first image marking engine (IME) including a seamed photoreceptor belt, a second IME including a seamed photoreceptor belt, a transport which transports print media sheet stock from the first IME to the second IME, and an inverter independent from the first IME and the second IME comprising:

(a) disposing the first IME and the second IME in tandem and feeding the print media sheet from the first IME to the second IME;

(b) disposing the independent inverter after the first IME and before the second IME;

(c) monitoring seam positions of the seamed photoreceptor belts of the first and second IMEs and scheduling arrival times for the print media sheet to arrive at the first IME and the second IME in response to the monitored seam positions so as to avoid the seams of the seamed photoreceptor belts;

(d) transporting, via the transport, the print media sheet after marking on one side thereof in the first IME from the first IME to the independent inverter;

(e) receiving the print media sheet after the marking on the one side thereof from the transport into the independent inverter and inverting the print media sheet;

(f) varying a dwell time of the print media sheet in the independent inverter in response to the scheduled arrival times in order to accommodate varying amounts of time between the scheduled arrival time to the first IME and the scheduled arrival time to the second IME and returning the print media sheet to the transport;

(g) transporting the print media sheet to the second IME after the varied dwell time and providing proper image registration thereon; and (h) operating the seamed photoreceptor belts independent of a synchronization therebetween.

* * * * *